US005133315A

United States Patent [19]

Reese

[11] Patent Number: 5,133,315

[45] Date of Patent: Jul. 28, 1992

[54] AXIAL FLOW COOLING AIR FILTER SYSTEM

[75] Inventor: Paul T. Reese, New Holstein, Wis.

[73] Assignee: Tecumseh Products Company, Tecumseh, Mich.

[21] Appl. No.: 796,406

[22] Filed: Nov. 22, 1991

[51] Int. Cl. ..... F02B 77/00

[52] U.S. Cl. ..... 123/198 E; 55/491

[58] Field of Search ..... 132/41.56, 41.65, 41.7, 132/198 E; 55/491, 522, DIG. 13, DIG. 42

[56] References Cited

U.S. PATENT DOCUMENTS

| | | | |
|---|---|---|---|
| 2,265,112 | 12/1941 | Davies | 230/127 |
| 2,920,717 | 1/1960 | Tuttle et al. | 183/44 |
| 3,278,114 | 10/1966 | Gibbs | 230/120 |
| 3,475,883 | 11/1969 | Sullivan | 55/290 |
| 3,722,182 | 3/1973 | Gilbertson | 55/124 |
| 3,907,531 | 9/1975 | Lee et al. | 55/491 |
| 3,938,586 | 2/1976 | Barlow et al. | 165/51 |
| 4,425,145 | 1/1984 | Reese | 55/385 |
| 4,781,526 | 11/1988 | Mead | 415/121 |

FOREIGN PATENT DOCUMENTS

| | | | |
|---|---|---|---|
| 1454543 | 11/1976 | United Kingdom | 55/DIG. 13 |

*Primary Examiner*—Noah P. Kamen

*Attorney, Agent, or Firm*—Baker & Daniels

[57] ABSTRACT

A filter assembly for filtering the cooling air entering the starter housing of a small air-cooled internal combustion engine. The assembly includes a plurality of upstanding brackets attached to the perforated face of the starter housing. The brackets include hook-shaped upstanding ends. A foam filter medium includes a plurality of slits formed therein, which correspond to the brackets. The filter is placed over the brackets and against the face of the housing such that the brackets receive the respective slits. A retaining ring is snapped into the hook-shaped ends for retaining the filter and for biasing the filter against the face of the starter housing to form a tight seal therebetween.

33 Claims, 4 Drawing Sheets

AXIAL FLOW COOLING AIR FILTER SYSTEM

BACKGROUND OF THE INVENTION

The present invention relates generally to air filter systems for small internal combustion engines, and more particularly to an air filter system for filtering debris from the cooling air entering the engine through the recoil starter housing.

In any air-cooled internal combustion engine, it is imperative that a continuous stream of cooling air be effectively directed over the hot cylinder block and crankcase surfaces during engine operation. In order to set up a cooling stream, a fan or blower is mounted on the flywheel end of the crankshaft. The fan can be a series of vanes on the surface of the flywheel, which are cast integrally with the wheel. If the vanes are on the outer surface of the flywheel, they are shaped in such a way that they draw air into the engine shroud, rather than push it through. Other designs use a stamped or pressed fan between the flywheel and the starter. Recently, recoil starters have been introduced that provide a flow of engine cooling air through the face of the starter housing and through the recoil pulley. Generally, the air entering the starter housing must be filtered, particularly in the case of lawn mowers, in which grass clippings can enter the cooling air stream and cause clogging between the shroud and the engine. Starter housings having perforated grilles may be successful in removing large particles from the cooling air stream; however, they are generally insufficient to remove smaller grass clippings as well as matted debris and dirt which may collect on the surfaces of the engine, or between the cooling fins. As a result of such accumulation, less surface area of the engine is exposed to the cooling air stream. In addition, the debris tends to insulate the hot metal surfaces from the cooling air stream. Therefore, it is desired to provide an air filter system that further inhibits the accumulation of dirt and debris from the cooling surfaces.

SUMMARY OF THE INVENTION

The present invention provides a foam filter medium that is removably mounted to the outer face of the starter housing of an air-cooled internal combustion engine, wherein the outer face has an air intake opening therein, so that the cooling air drawn in the through the opening is filtered sufficiently to inhibit the accumulation of dirt and debris on the cooling surfaces of the engine.

Generally, the invention provides an internal combustion engine including a recoil starter housing having a perforated outer face. Cooling air is drawn in through the face and around the crankcase for cooling the hot crankcase surfaces. An open cell foam filter medium is removably mounted to the outer face for filtering the drawn cooling air.

More particularly, the present invention provides, in one form thereof, a plurality of upstanding flexible brackets mounted on the outer face of the starter housing and spaced about the face circumferentially. A foam polyurethane filter medium includes a plurality of slits therein which correspond to the upstanding brackets. The filter is disposed over the brackets and onto the outer face such that each bracket receives a slit. A retaining ring snaps into U-shaped hooks at the ends of the flexible brackets to secure and bias the filter medium against the outer face, thereby forming a tight seal between the outer face and the filter medium.

In another embodiment, the present invention provides a starter housing separate from the blower housing such that cooling air is admitted through both the perforated outer face of the starter housing and the periphery of the starter housing. In this embodiment, an additional ring-shaped filter medium is provided for filtering the air entering through the periphery of the starter housing This filter medium is in addition to the above-described filter medium for the outer face of the starter housing.

An advantage of the filter assembly of the present invention is that small grass clippings and other matted debris are filtered from the cooling air entering the starter housing, thereby inhibiting the accumulation of debris on the cooling surfaces of the engine.

Another advantage of the filter assembly of the present invention is that the filter element may be easily installed and removed for service and replacement, without the use of tools.

Yet another advantage of the filter assembly of the present invention is that the assembly is compact and may be retrofitted to existing engines, if desired.

Another advantage of the filter assembly of the present invention is that the filter element has a surface area several times greater than the air inlet grille in the starter housing, which allows for greater debris accumulation without restricting cooling air flow.

The present invention, in one form thereof, provides an internal combustion engine comprising a crankcase and a housing mounted to the crankcase. The housing includes an outer face having an air intake opening therein. A blower is provided for drawing outside air through the opening and around the crankcase, cylinder, and cylinder head for cooling. An open cell foam filter medium is removably mounted to the outer face to filter the drawn outside air.

The invention further provides, in one form thereof, such an engine in which the housing includes an outer perimeter having a second air intake opening therein. A second open cell filter medium is removably mounted to the outer perimeter for filter the drawn outside air entering through the second opening.

The present invention further comprises, in one form thereof, a method for assembling a filter for filtering the drawn outside air. The method includes securing a plurality of upstanding retaining brackets to the face of the housing. A filter element is provided having a plurality of openings therein, wherein each opening corresponds to one of the upstanding brackets. The filter element is disposed over the face such that each of the brackets extends into a respective slit in the filter element. A fastener is then removably secured to the brackets for securing the filter element against the face.

DESCRIPTION OF THE PREFERRED EMBODIMENT

Figure 1:
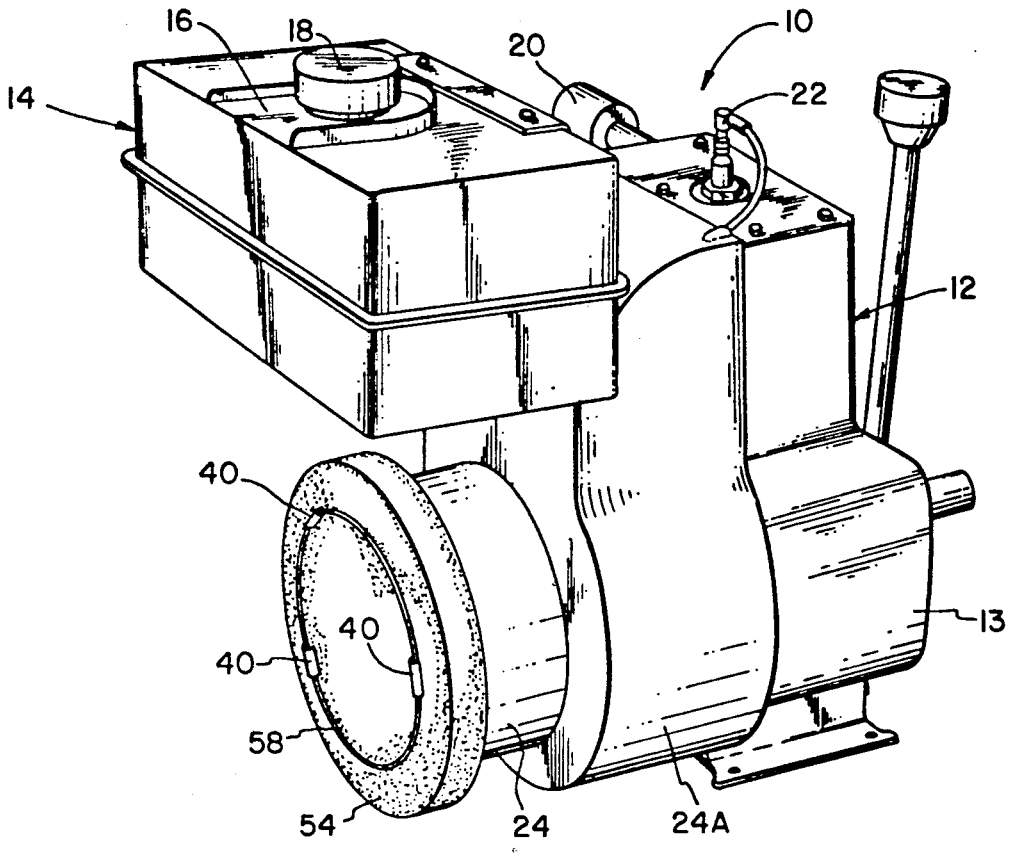
FIG. 1 is a perspective view of a small internal combustion engine incorporating the air filter system in accordance with the principles of the present invention.

Referring now to the drawings, and in particular to FIG. 1, there is shown a conventional small air-cooled internal combustion engine 10, as is conventionally used for lawn mowers, sprayers, tillers, shredders, agricultural equipment, etc. Engine 10 includes a cylinder block assembly 12 and a fuel tank 14, which includes a conventional spill dam area 16 and a fuel cap 18. Engine 10 further includes a muffler 20 and a sparkplug 22 for igniting the fuel-air mixture in the combustion chamber (not shown). The remaining components of engine 10 (e.g., camshaft, crankshaft, piston, etc.) are well known and consequently are omitted for the sake of clarity in the following description.

Figure 3:
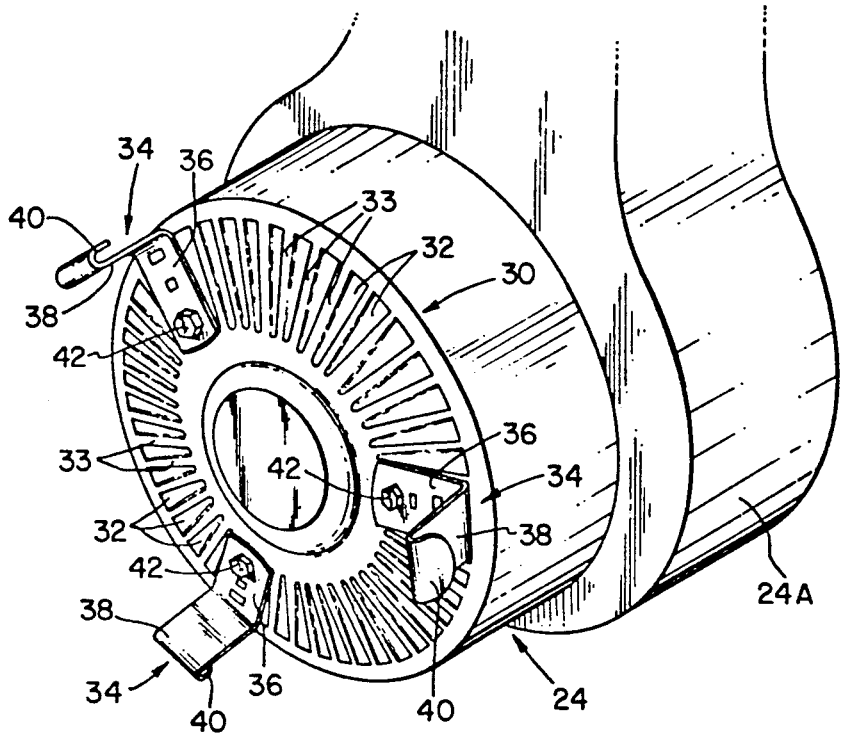
FIG. 3 is an enlarged perspective view of the starter housing, particularly showing the mounting brackets installed thereon.

Referring to FIG. 3, a housing arrangement 24A is mounted to cylinder block assembly 12 and houses a flywheel (not shown) which includes a plurality of air circulating blades or vanes 26 (FIG. 8) for circulating cooling air through starter housing 24 and around crankcase 12 for air cooling of the engine. A manual recoil starter housing arrangement 24 is positioned above the flywheel on housing 24A. A pull start handle 28 (FIG. 7) extends from starter housing 24 and is attached to a starter rope (not shown) that is spirally wound around a pulley or sheave (not shown) in a conventional manner. A conventional outer face or air inlet grille 30 is provided at the outer axial end of starter housing 24 and includes a plurality of radially extending air inlet openings 32 which are spaced about grille 30 and define ribs 33 as shown in FIG. 3. The term "perforated face" may also be used to describe grille 30

Figure 4:
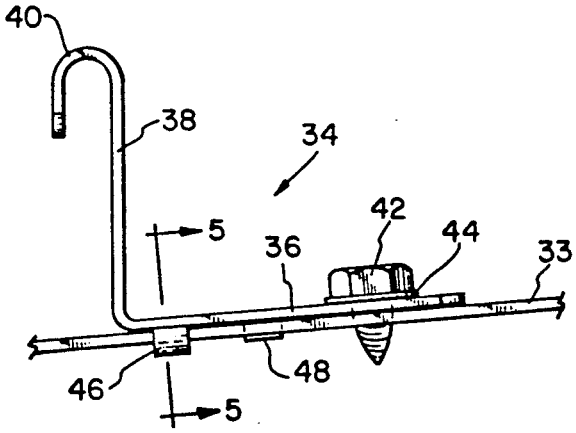
FIG. 4 is an enlarged side view of a bracket of FIG. 3, showing its installation on the starter housing.

In accordance with an embodiment of the present invention, there is shown in FIGS. 3-6, three upstanding flexible brackets which are mounted circumferentially about air inlet grille 30 on selected ribs 33. As best shown in FIG. 4, each bracket 34 is generally L-shaped and includes a first or base leg 36 that is parallel with and attached to a rib 33 of grille surface 30 and a second or upstanding leg 38 which is approximately normal to leg 36 and extends axially outwardly of grille 30 as shown in FIG. 3. The outer axial end 40 of leg 38 forms a bend or hook back in the direction of grille 30 for retaining a fastener in the form of an attachment ring, which will be discussed hereinafter Base leg 36 includes an opening (not shown) adapted to engage a screw 42 to fasten leg 36 securely to rib 33 of grille 30. If screw 42 is not a self-tapping and selflocking locking screw, washer 44 is provided to enable a tight fit.

Figure 6:
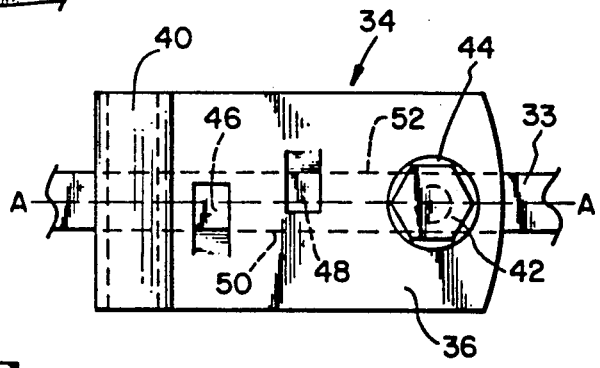
FIG. 6 is a top view of the mounting bracket of FIG. 4.
Figure 5:
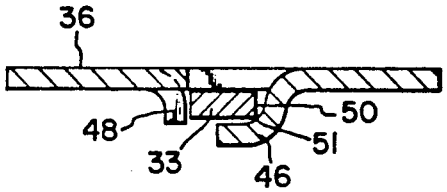
FIG. 5 is an enlarged sectional view of the bracket of FIG. 4, taken along line 5—5 in FIG. 4.

Referring to FIGS. 5 and 6, base leg 36 further includes cantilevered ear portions 46 and 48 for preventing rotational movement of base portion 36 about longitudinal axis A—A through rib 33. As shown in FIG. 5, ear 46 extends downwardly from leg 36 and parallel thereto, but transverse to axis A—A. As shown, ear 46 extends beneath rib 33 and engages corner 51 of edge 50 to prevent rotational movement of leg 36 with respect to edge 50. Likewise, ear 48 which extends from the opposite side of axis A—A extends downwardly from leg 36 and substantially parallel thereto, but transverse to axis A—A. Ear 48 also extends beneath rib 33 to prevent rotational movement of leg 36 with respect to edge 52. As shown in FIG. 6, ears 46 and 48 are longitudinally displaced from one another along axis A—A.

Once brackets 34 have been securely installed on grille 30, a flexible open cell foam filter medium 54 of the type conventionally used in small engine air cleaners is disposed over each of the brackets. Filter 54 is preferably in the form of an annular disk and is preferably made of an open pore reticulated polyurethane material that is resiliently compressible and has a range of porosity from 10 to 50, and preferably 20 pores per square inch. It will be appreciated by those skilled in the art that other materials may be utilized as the filter medium, e.g. polyester or polyeather foam, rubberized hog hair or horsehair, steel wool or aluminum wool, etc. It is also possible to have a filter medium made from a combination of these materials. An example is a filter medium comprising 40% neoprene and 60% hog hair.

Figure 7:
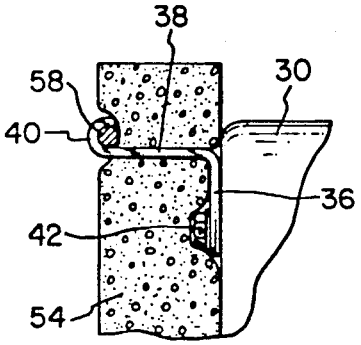
FIG. 7 is a partial assembled view of the air filter system of FIG. 2.

Filter 54 includes a plurality of slits 56 therein for being received by an appropriate upstanding leg 38 of a bracket 34. Filter 54 is of such a thickness that once the foam filter has been disposed over brackets 34, the brackets extend to a height that is below the outer surface of the filter. Thereafter an annular retaining ring 58 is secured within hook members 40 of brackets 34, thereby compressing filter 54 to generate a circle of firm contact between the bottom surface of filter 54 and the face of grille 30. Brackets 34 are flexible enough so that ring 58 is snapped into place in hooked ends 40 and frictionally retained therein. As shown in FIG. 7, the compressed filter biases ring 58 upwardly against hooked end 40. The biasing of filter 54 prevents debris from creeping into the inlet grille at the filter/starter interface. Filter 54 is easily removed for cleaning by unsnapping ring 58 from hooked ends 40, removing ring 58, and lifting filter 54 off brackets 34.

Figure 8:
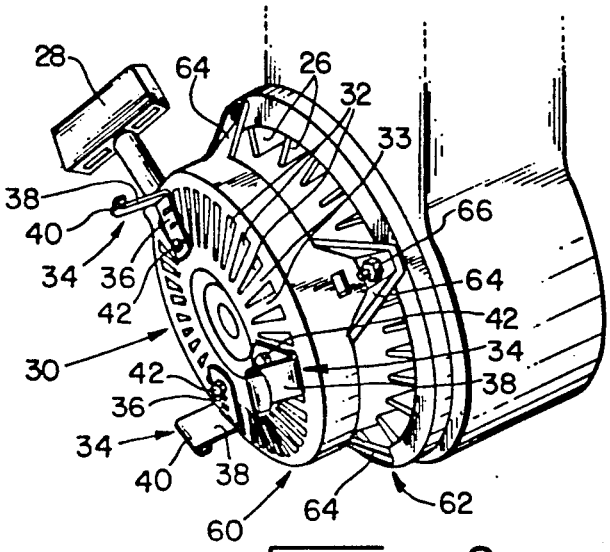
FIG. 8 is an enlarged perspective view of an alternative embodiment of the starter housing of FIG. 1, particularly showing the mounting brackets attached to the starter housing.
Figure 9:
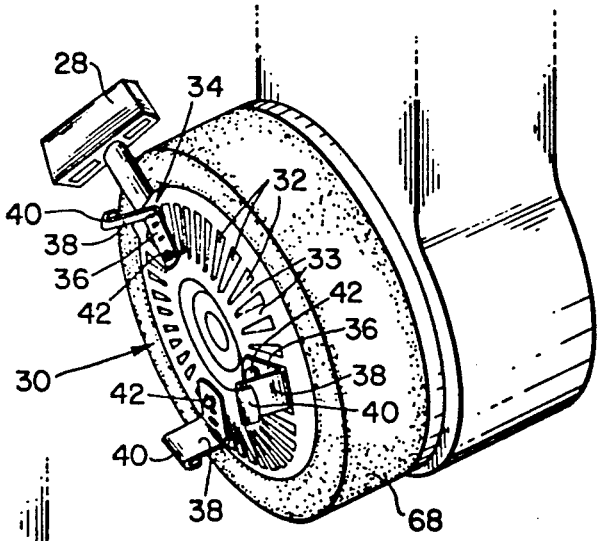
FIG. 9 is a view of FIG. 8 except that a ring-shaped filter has been attached to the starter housing for providing air filtration for perimeter breathing.
Figure 10:
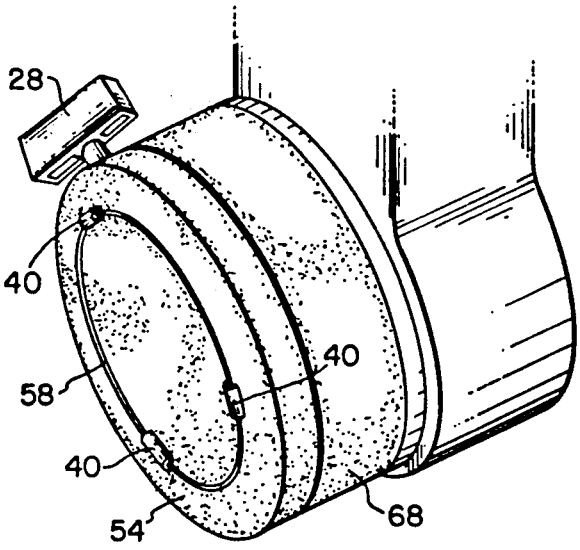
FIG. 10 is a view similar to FIG. 9 except that an additional filter element has been attached to brackets 34 to provide air filtration for the face breathing openings of the starter housing.

Referring to FIGS. 8-10, an alternative embodiment is shown, wherein starter housing 60 is separate from blower housing 62. In this embodiment, flange portions 64 of housing 60 are secured to housing 62 by a screw/nut arrangement 66. As a result, cooling air enters both through openings 32 in grille 30 ("face breathing") and through the opening between housing 60 and housing 62 ("perimeter breathing"). Therefore, an additional ring-shaped filter medium 68 must be installed about the starter housing 62, as shown in FIG. 9. Filter 68 is preferably made of the same material and has the same outside diameter as filter 54. Once filter 62 is attached, filter 54 may be attached as described above. In this instance, ring 58 additionally biases filter 54 against filter 68 to further secure filter 68 in position.

Figure 2:
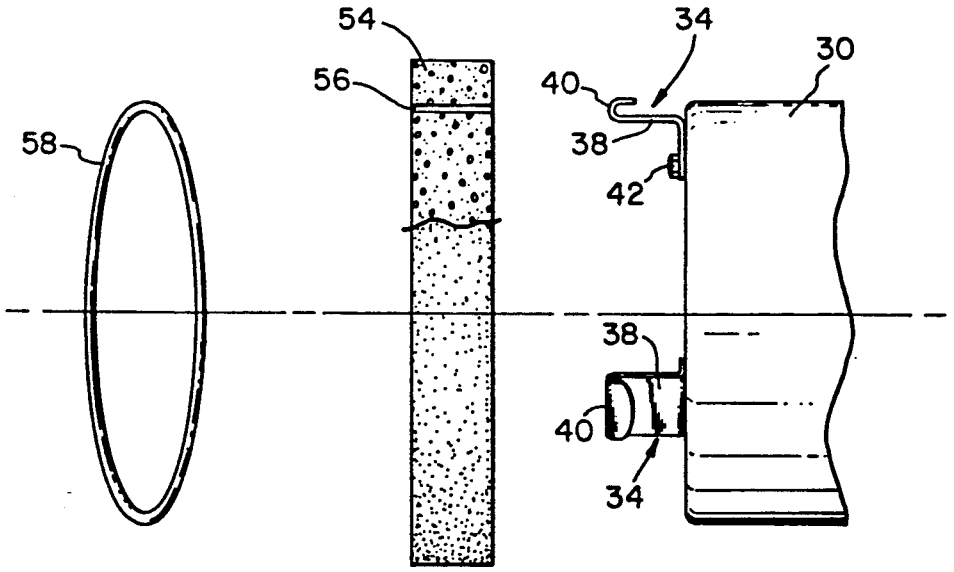
FIG. 2 is an enlarged elevational and exploded view of the components of the air filter system of FIG. 1.
Figure 11:
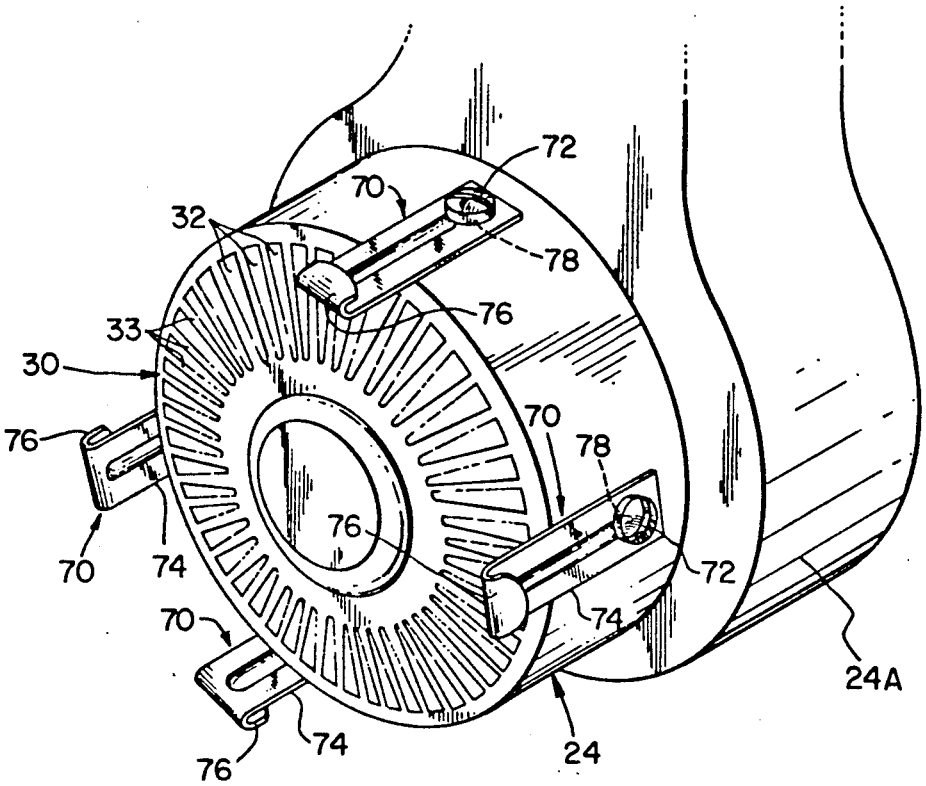
FIG. 11 is a view similar to FIG. 3, but showing an alternative mounting bracket design.

Referring to FIG. 11, an alternative mounting bracket design is shown as applied to the starter housing shown in FIGS. 1-3, wherein four mounting brackets 70 are circumferentially spaced about starter housing 24 and retained by fasteners 72. Brackets 70 each include a single leg or base 74 having an upstanding hook-shaped end 76 and an opening 78 opposite end 76 for receiving fastener 72. It is appreciated that opening 78 may instead be a slot (not shown) to permit the end to be slid over the threaded portion of screw 72, thereby enabling screw 72 to be attached to starter housing 24 before attachment of brackets 70 to housing 24.

Figure 12:
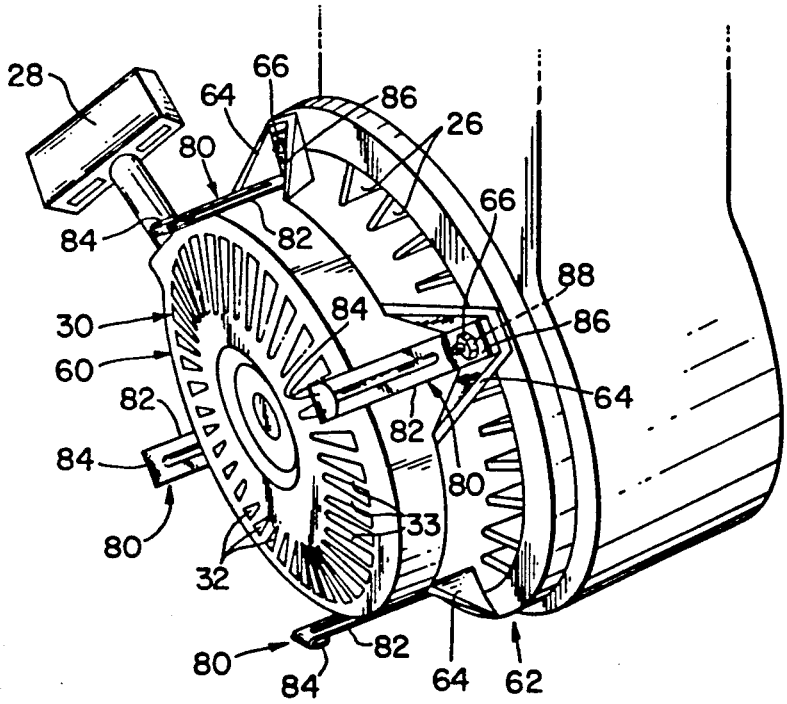
FIG. 12 is an enlarged view similar to FIG. 8, but showing an alternative mounting bracket design.

Referring now to FIG. 12, an alternative mounting bracket design is shown as applied to the starter housing shown in FIGS. 8-10. In this arrangement, bracket 80 includes an upstanding leg 82 having a hook-shaped end 84, and a base leg 86 having an opening 88 therein for the reception of fastener 66. In addition to the arrangements shown in FIGS. 11 and 12, it is appreciated that still other possible mounting bracket configurations are possible for securely retaining filter medium 54 onto grille 30.

It will be appreciated that the foregoing is presented by way of illustration only, and not by way of any limitation, and that various alternatives and modifications may be made to the illustrated embodiment without departing from the spirit and scope of the invention.

What is claimed is:

1. An internal combustion engine comprising:
a cylinder block assembly;
a starter housing mounted to said cylinder block assembly and including a recoil starter housing with an outer face having an air intake opening therein;
blower means for drawing outside air through said opening and around said cylinder block assembly for cooling said assembly; and
an open cell foam filter medium removably mounted to said outer face for filtering the drawn outside air.

2. The engine of claim 1, wherein a recoil starter is mounted in said starter housing for cranking the engine.

3. The engine of claim 1, wherein the foam filter is made of a polyurethane material and has a range of porosity from about 10 to about 50 pores per square inch.

4. The engine of claim 1, wherein at least one upstanding bracket is mounted on said outer face.

5. The engine of claim 4, wherein said bracket includes a first leg and a second leg, said legs together being generally L-shaped.

6. The engine of claim 5, wherein said first leg is secured to said outer face, and said second upstanding leg includes a hook-shaped outer axial end.

7. The engine of claim 6, wherein said outer face includes a second air intake opening spaced from said first air intake opening to define a radially extending rib therebetween, wherein said first leg is secured to and lies parallel with said rib.

8. The engine of claim 7, wherein said first leg includes means for preventing rotation of said first leg about the longitudinal axis thereof.

9. The engine of claim 8, wherein said rotational prevention means includes a first cantilevered ear portion on a first side of said longitudinal axis and extending downwardly from said first leg and toward said axis, a second cantilevered ear portion on a second and opposite side of said axis and extending downwardly from said first leg and toward said axis, whereby said first ear engages a first side of said rib and said second ear engages a second and opposite side of said rib.

10. The engine of claim 9, wherein said first ear is longitudinally displaced from said second ear.

11. The engine of claim 4, wherein said foam filter medium includes a slit therein corresponding to said upstanding bracket, whereby said filter medium is disposed over said bracket and onto said face such that said bracket is received in said slit.

12. The engine of claim 11, wherein a fastener is secured to said bracket for securing said filter medium against said face.

13. The engine of claim 12, wherein a second upstanding bracket is mounted on said face, said first and second brackets each including a flexible hook-shaped upstanding end, wherein said upstanding ends frictionally receive said fastener.

14. The engine of claim 13, wherein said fastener is an annular retaining ring.

15. The engine of claim 12, wherein said fastener biases said filter medium against said face to form a region of firm contact between said fastener and said filter.

16. The engine of claim 1, wherein said filter medium extends radially beyond said air intake opening.

17. The engine of claim 1, wherein at least one bracket is mounted on the periphery of said starter housing.

18. The engine of claim 1, wherein said housing includes an outer perimeter having a second air intake opening therein, wherein a second open self filter medium is removably mounted to said outer perimeter for filtering the drawn outside air entering through said second opening 19. The engine of claim 18, wherein said second filter medium is substantially ring-shaped.

20. The engine of claim 18, wherein said second foam filter medium is made of an open pore reticulated polyurethane material and has a porosity of about 20 pores per square inch.

21. The engine of claim 1, further comprising:
an upstanding bracket mounted on said outer face and including a hook-shaped upstanding axial end;
said foam filter medium being resiliently compressible and including a slit therein corresponding to said upstanding bracket, whereby said filter medium is disposed over said bracket and onto said face such that said bracket is received in said slit; and
a fastener disposed within said hook-shaped end and compressing said filter medium sufficiently to cause said filter medium to bias said fastener against said hook-shaped end.

22. In an internal combustion engine having a blower housing, a starter housing mounted to the blower housing in which a starter is located for cranking an engine, wherein said starter housing includes an outer face and an air intake opening therein, and blower means for drawing outside air through said opening and around the engine casting for cooling the engine, an air filter assembly, comprising:
a plurality of upstanding brackets mounted circumferentially about said outer face, wherein each said bracket includes a flexible hook-shaped upstanding end;
an open cell foam filter medium having a plurality of slits therein, each said slit corresponding to each said bracket, whereby said filter medium is disposed over said bracket and onto said face such that each said bracket receives a respective slit; and a fastener removably secured to said brackets for securing said filter medium against said face, said fastener comprising an annular retaining ring which is received in said hook members and biases said filter medium against said outer face.

23. The engine of claim 22, wherein the foam filter is made of a polyurethane material and has a porousness of about 20 pores per square inch.

24. The engine of claim 22, wherein said bracket includes a first leg secured to said outer face and an upstanding second leg.

25. The engine of claim 24, wherein said outer face includes a second air intake opening spaced from said first air intake opening to define a radially extending rib therebetween, wherein said first leg is secured to and lies parallel with said rib.

26. The engine of claim 25, wherein said first leg includes means for preventing rotation of said first leg about the longitudinal axis thereof.

27. The engine of claim 26, wherein said rotational prevention means includes a first cantilevered ear portion on a first side of said longitudinal axis and extending downwardly from said first leg and toward said axis, a second cantilevered ear portion on a second and opposite side of said axis and extending downwardly from said first leg and toward said axis, whereby said first ear engages a first side of said rib and said second ear engages a second and opposite side of said rib.

28. The engine of claim 27, wherein said first ear is longitudinally displaced from said second ear.

29. The engine of claim 22, wherein said filter medium extends radially beyond said air intake opening.

30. The engine of claim 22, wherein said filter medium is resiliently compressible and biases said retaining ring against said brackets to hold said retaining ring in place.

31. In an internal combustion engine comprising a crankcase housing mounted to said crankcase and including an outer face having an air intake opening therein, and blower means for drawing outside air through said opening and around said crankcase, a method for assembling a filter for filtering the drawn outside air, the method comprising:

securing a plurality of upstanding retaining brackets to said face;

providing a filter element having a plurality of slits therein, each said opening corresponding to one of said upstanding brackets;

disposing said filter element over said face such that each of said brackets extends into a respective slit in said filter element; and removably securing a fastener to said brackets for securing said filter element against said face.

32. The method of claim 31, wherein said housing includes an outer perimeter having a second air intake opening therein, the method comprising the step of removably mounting a second open cell filter medium to said outer perimeter for filtering the drawn outside air entering through said second opening.

33. The method of claim 31, wherein said filter medium is resiliently compressible, and the step of securing said fastener to said brackets includes the steps of:

forcing said fastener against said filter medium to compress said filter medium until said brackets extend through their respective slits;

inserting said fastener in said brackets; and releasing said fastener to permit said filter medium to bias said fastener against said brackets to hold said filter medium in place.

* * * * *